United States Patent [19]

Rankel et al.

[11] 4,414,102

[45] Nov. 8, 1983

[54] PROCESS FOR REDUCING NITROGEN AND/OR OXYGEN HETEROATOM CONTENT OF A MINERAL OIL

[75] Inventors: Lillian A. Rankel, Plainsboro; Leslie R. Rudnick, Trenton, both of N.J.

[73] Assignee: Mobil Oil Corporation, New York, N.Y.

[21] Appl. No.: 263,820

[22] Filed: May 15, 1981

[51] Int. Cl.[3] ..... C10G 45/00; C10G 45/04; C10G 45/60; C10G 45/08

[52] U.S. Cl. ..... 208/211; 208/216 R; 208/254 R; 208/263

[58] Field of Search ..... 208/211, 254 R, 263, 208/216 R, 210

[56] References Cited

U.S. PATENT DOCUMENTS

| | | | |
|---|---|---|---|
| 3,016,346 | 1/1962 | O'Hara | 208/216 R |
| 3,169,918 | 2/1965 | Gleim | 208/216 R |
| 3,197,483 | 7/1965 | Buchholz | 260/332.8 |
| 3,271,302 | 9/1966 | Gleim | 208/216 R |
| 3,306,910 | 2/1967 | Louthan | 260/326.83 |
| 3,331,769 | 7/1967 | Gatsis | 208/216 R |
| 3,378,485 | 4/1968 | Rampino | 208/263 |
| 3,394,077 | 7/1968 | Kovach et al. | 208/216 R |
| 3,595,780 | 7/1971 | Adams et al. | 208/211 |
| 3,850,744 | 11/1974 | Plundo et al. | 208/210 |
| 3,876,532 | 11/1975 | Plundo et al. | 208/216 |
| 4,021,334 | 5/1977 | Gorring et al. | 208/211 |
| 4,088,698 | 5/1978 | Fishel et al. | 260/609 D |
| 4,143,052 | 3/1979 | Barrault et al. | 260/329 R |
| 4,213,850 | 7/1980 | Riddick, Jr. et al. | 208/216 R |

FOREIGN PATENT DOCUMENTS

| | | | |
|---|---|---|---|
| 668664 | 8/1963 | Canada | 208/254 R |
| 345738 | 4/1931 | United Kingdom | 208/211 |

OTHER PUBLICATIONS

Dehydrodesulfurization, The Oil and Gas Journal, H. Hoag et al., Jun. 8, 1953, vol. 52, No. 5.

Magnusson, *Acta. Chem. Scand.*, 16, 1536 (1962) and 17, 273 (1963).

*Primary Examiner*—Delbert E. Gantz
*Assistant Examiner*—Helane E. Maull
*Attorney, Agent, or Firm*—Alexander J. McKillop; Charles J. Speciale; Laurence P. Hobbes

[57] ABSTRACT

The nitrogen-containing and oxygen-containing contaminants of a mineral oil are converted to the corresponding sulfur compounds by contacting the oil with a fresh catalyst containing metals from Groups VB, VIB and VIII or a deactivated and metals contaminated hydrodesulfurization catalyst in the presence of hydrogen and hydrogen sulfide under conditions of elevated temperature and pressure.

18 Claims, No Drawings

PROCESS FOR REDUCING NITROGEN AND/OR OXYGEN HETEROATOM CONTENT OF A MINERAL OIL

BACKGROUND OF THE INVENTION

1. Field of the Invention

This invention relates to mineral oils containing significant amounts of nitrogen-containing components and/or oxygen-containing components. It particularly relates to a process for substantially reducing the nitrogen and/or oxygen content of a mineral oil. This invention especially relates to a process for converting the nitrogen-containing components and/or the oxygen-containing components in a petroleum oil to sulfur-containing components.

2. Background of the Invention

Mineral oils, such as petroleum, shale oil, tar sands oil, coal derived oils, organic matter derived oils, and other natural mineral oils often contain non-metallic and metallic impurities which may adversely affect the various processes employed to refine or treat the hydrocarbon fractions of such mineral oils. The metallic impurities include compounds of nickel, vanadium, iron, calcium, magnesium, copper, lead or zinc. Especially troublesome, as catalyst poisons, are those impurities which contain nickel and vanadium. The non-metallic impurities consist of compounds containing nitrogen, sulfur and oxygen. These are often organic hydrocarbon compounds containing these impurities as heteroatoms. Both the metallic and nonmetallic impurities are undesirable in that they adversely affect such catalytic hydrocarbon processes as catalytic reforming, catalytic cracking and other catalytic processes, by poisoning the catalyst used in these processes.

Crude oils and other sources of hydrocarbons contain these impurities to varying degrees depending upon geographic origin. Crude oils containing these impurities in minor amounts usually have commanded a premium price because of their ability to be processed with catalysts for prolonged periods of time before poisoning occurs. Conversely, crude oils containing higher percentages of non-metallic and metallic impurities have been less costly because they often require additional upstream processing to remove these impurities before catalytic processing techniques could be effectively employed. In view of the higher prices commanded by the OPEC nations for premium quality crudes, lower quality crude oils have become more economically attractive provided cost effective techniques are available for the removal of the catalyst poisoning contaminants they usually contain.

Various techniques have been developed to remove significant quantities of the non-metallic and metallic contaminants from crude oils to permit efficient catalytic processing of these materials. Catalytic hydroprocessing is one of the most effective techniques for contaminant removal which has been developed heretofore and has essentially replaced such prior art techniques as acid treating, caustic treating and clay treating which were employed for contaminant removal but created severe disposal and ecological problems.

Depending upon the degree of contaminant removal desired, catalytic hydroprocessing can be adapted to operate under very mild or under very severe conditions and may be employed to treat feedstocks ranging from crude oils and reduced crudes to light virgin naphthas. Not only does hydroprocessing reduce contaminant level but it results in reduced coke production in such downstream processes as catalytic cracking which means both increased gasoline yield and higher octane of the gasoline fraction. Catalytic hydroprocessing, as its name suggests, is conducted in the presence of hydrogen, and a regenerable metal catalyst. Operating conditions usually include pressures in the range of 500 to 1500 psig and temperatures in the range of 400 to 800° F. Where oxygen, nitrogen and sulfur are the principal contaminants removed, the process is referred to as hydrodesulfurization. It has been found that the oxygen and nitrogen compounds require more servere conditions for effective removal than do the corresponding sulfur compounds. Less severe hydrodesulfurization processing conditions could be employed therefore, if the nonmetallic contaminants in the crude oil or petroleum fraction consisted only of sulfur. Thus, if the oxygen and nitrogen contaminants in the mineral oil could be effectively and economically converted to the corresponding sulfur compounds, a less costly hydrodesulfurization process could be employed to complete the removal of the nometallic contaminants.

The prior art has employed hydrogen sulfide to convert nitrogen and oxygen containing organic molecules to sulfur containing molecules. For example, $H_2S$ has been reacted with enamines at −40 to 0° C. in the presence of ether to provide the corresponding dimercapto organic compounds (Magnusson, *Acta Chem. Scand.*, 16, 1536 (1962) and 17, 273 (1963)). U.S. Pat. No. 3,306,910 of Louthan discloses that hydrogen sulfide will react with lactams at 200 to 300° C. and 1 to 500 psig with a sodium hydroxide catalyst so that a sulfur atom is substituted for the carbonyl oxygen. U.S. Pat. No. 3,197,483 of Buchholz et al., relates to the replacement of the oxygen in cyclic ethers with sulfur by reaction with hydrogen sulfide in the presence of phosphotungstic acid supported on alumina. A process for converting phenols to thiophenols by reacting them with hydrogen sulfide at temperatures of 300°–400° C. in the presence of a vanadia catalyst is disclosed in U.S. Pat. No. 4,088,698 of Fishel et al. U.S. Pat. No. 4,143,052 of Barrault et al. relates to the preparation of a thiophene by the reaction of hydrogen sulfide with an unsaturated aldehyde, thioaldehyde, ketone or thioketone at 250°–500° C. in the presence of an alumina catalyst containing an alkali or alkaline earth oxide. None of this prior art suggests that the disclosed processes are applicable to a complex mixture such as a hydrocarbon petroleum fraction.

Hydroprocessing catalysts, including hydrodesulfurization catalysts, usually consist of a Group VIB and Group VIII metal in oxide or sulfide form supported on an inorganic metal oxide support having little, if any, cracking activity. Group VIB metals are usually selected from chromium, molybdenum and tungsten while the Group VIII metals are usually either cobalt or nickel. Various combinations of these two metal groups are employed. Alumina is the inorganic metal oxide which is most commonly employed as the support.

Carbonaceous materials gradually build up on a hydroprocessing catalyst slowly deactivating it. Periodically these deposits are burned off the catalyst under controlled oxidative conditions. The regenerated catalyst has a somewhat diminished activity which can be compensated for by increasing the reaction temperature slightly when the catalyst is returned to service. However, there reaches a point where the catalyst activity has been so depleted following extended use and numerous regenerations that the time between regenerations is too short to be economically attractive despite the use of increasingly higher reaction temperatures. At this point the permanently deactivated catalyst is replaced with fresh catalyst. Both permanently deactivated and temporarily deactivated catalysts have found use per se in the prior art. U.S. Pat. No. 3,378,485 of Rampino discloses that the haze in a caustic treated diesel fuel distallate can be removed by passing the distillate through a bed of deactivated but regenerable hydrodesulfurization catalyst, such as a cobalt-molybdate catalyst. U.S. Pat. Nos. 3,850,744 and 3,876,532 of Plundo et al. relate to the use of a permanently deactivated hydrotreating catalyst. Plundo et al. found that such catalysts still possess sufficient activity for use in a relatively low pressure and mild hydrotreating process for virgin middle distillates such as, straight run furnace oil, jet fuel or kerosene whose macaptan level only requires a mild hydrotreating. Neither Rampino nor Plundo et al. suggest using a deactivated hydroprocessing catalyst or a fresh catalyst containing the metals of a deactivated hydroprocessing catalyst to convert nitrogen and oxygen components in a mineral oil to the corresponding sulfur compounds.

It is an object of this invention to provide a process for reducing the oxygen and nitrogen content of a mineral oil fraction so as to reduce the severity normally required in a hydrodesulfurization process.

It is a further object of this invention to convert the nitrogen and oxygen containing components in a mineral oil to the corresponding sulfur compounds which in turn can effectively be removed in a subsequent hydrodesulfurization process operated under less severe conditions than would otherwise be required.

SUMMARY OF THE INVENTION

In accordance with the present invention, it has been found that a hydrodesulfurization process which will effectively reduce the nitrogen, oxygen and sulfur contaminates of a mineral oil containing significant quantities of these contaminants, can be operated under less severe conditions while providing the same quality product if the feed to the hydrodesulfurization process is initially subjected to a reaction with hydrogen and hydrogen sulfide in the presence of a catalyst containing Group VB, Group VIB and Group VIII metals under reaction conditions which are effective to convert the nitrogen and oxygen contaminants to the corresponding sulfur compounds. Useful catalysts include a fresh catalyst containing the above metals and a deactivated but regenerable hydrodesulfurization catalyst.

More particularly, this invention is concerned with a process for the transformation of nitrogen or oxygen containing components of a mineral oil to sulfur containing components which comprises:

contacting a mineral oil comprising nitrogen-containing or oxygen-containing components with hydrogen, hydrogen sulfide and a fresh multimetal catalyst under process conditions effective to transform nitrogen-containing or oxygen-containing components to sulfur-containing components of said mineral oil, said multimetal being a Group VB metal, a Group VIB metal and a Group VIII metal or mixtures thereof.

This invention may also be described as being directed to a process for substantially reducing the nitrogen, oxygen and sulfur contents of a mineral oil containing significant quantities of nitrogen, oxygen and sulfur components which comprises:

(a) contacting a mineral oil comprising nitrogen-containing components, oxygen-containing components and sulfur-containing components with hydrogen, hydrogen sulfide and a fresh multimetal catalyst under process conditions effective to transform nitrogen-containing and oxygen-containing components of said mineral oil to sulfur-containing components, said multimetal being a Group VB metal, a Group VIB metal and a Group VIII metal or mixtures thereof and (b) passing the treated mineral oil of step (a) in contact with a hydrodesulfurization catalyst under hydrodesulfurization conditions effective to substantially reduce the sulfur content of the treated mineral oil.

In the embodiment employing a deactivated catalyst, this invention is directed to a process for the transformation of nitrogen or oxygen containing components of a mineral oil to sulfur containing components which comprises:

contacting a mineral oil comprising nitrogen-containing or oxygen-containing components with hydrogen, hydrogen sulfide and a deactivated and metals contaminated hydrodesulfurization catalyst under process conditions effective to transform nitrogen-containing or oxygen-containing components to sulfur-containing components of said mineral oil, said hydrodesulfurization catalyst contaminated with metals comprising nickel and vanadium.

This latter embodiment may further be described as being directed to a process for substantially reducing the nitrogen, oxygen and sulfur content of a mineral oil containing significant quantities of nitrogen, oxygen and sulfur components which comprises:

(a) contacting a mineral oil comprising nitrogen-containing components, oxygen-containing components, sulfur-containing components, nickel and vanadium with hydrogen, hydrogen sulfide and a deactivated and metals contaminated hydrodesulfurization catalyst under process conditions effective to transorm nitrogen-containing and oxygen-containing components of said mineral oil to sulfur-containing components, said hydrodesulfurization catalyst contaminated with metals comprising nickel and vanadium, and (b) passing the treated mineral oil of step (a) in contact with a hydrodesulfurization catalyst under hydrodesulfurization conditions effective to substantially reduce the sulfur content of the treated mineral oil.

DESCRIPTION OF THE PREFERRED EMBODIMENTS

The present invention relates to providing a mineral oil, contaminated with nitrogen, oxygen, and sulfur compounds, in a condition whereby the concentration of these nitrogen, oxygen and sulfur compounds is significantly reduced so as to enable the mineral oil to be effectively and efficiently processed with catalysts which are poisoned or deactivated by oxygen, nitrogen and sulfur compounds. The invention described herein provides an alternative to the severe operating conditions which have been employed heretofore in hydrodesulfurization to reduce the nitrogen, oxygen and sulfur content of mineral oils to a satisfactory level. Briefly, the invention may be described as employing hydrogen sulfide and hydrogen to convert the nitrogen and oxygen to the corresponding sulfur compounds and then to reduce the sulfur composition of the mineral oil to a satisfactory level through the use of a hydrodesulfurization process utilizing less severe conditions than would otherwise be required. Although the name of the hydroprocessing technique known as hydrodesulfurization would appear to indicate that only sulfur is removed from the mineral oil, hydrodesulfurization usually accomplishes much more. Although oxygen and nitrogen compounds are more difficult to remove than are sulfur compounds, this process may be operated under severe enough conditions so as to effectively remove not only the sulfur compounds but the nitrogen and oxygen ones as well.

Although it is known that hydrogen sulfide will react with oxygen-containing and nitrogen-containing organic compounds to replace the oxygen and nitrogen with sulfur, a wide variety of temperatures and pressures as well as numerous and mutually exclusive catalysts have been disclosed for the various general classes of organic compounds to which the technique was applied. No single set of operating conditions and no single catalyst type has been disclosed, as being effective; apparently none was found to be useful for all these situations. Since petroleum hydrocarbons containing oxygen, nitrogen and sulfur contaminants comprise such a wide variety of complex molecules, it was surprising that, the nitrogen and oxygen level of such a hydrocarbon fraction could be significantly reduced, at the expense of increasing sulfur content, by contacting the hydrocarbon fraction with hydrogen sulfide and hydrogen in the presence of a metal catalyst in accordance with the present invention. It was also found that following this treatment a conventional hydrodeulsurization catalyst operating under mild conditions could easily remove the sulfur originally present in the hydrocarbon distillate as well as the sulfur compounds to which the nitrogen and oxygen compounds had been converted.

The present invention is effective with a wide variety of feedstocks. Distillates in the gasoline, kerosene, gas oil, diesel oil, lubricating oil distillate, and fuel oil boiling ranges, as well as straight run reduced crude may serve as feedstocks in the process of this invention. Although these feedstocks are conventionally derived from petroleum, other sources of useful feedstocks may include oils derived from shale oil, tar sands, coal and organic matter. The subject process is especially suited for treating catalytic cracking and catalytic reforming feedstocks.

The catalysts which may be employed in the transformation of this invention comprise fresh multimetal catalysts and those catalysts which are suitable for hydroprocessing. In the latter category the preferred catalyst is a hydrodesulfurization catalyst which is deactivated but regenerable and is metals contaminated. The fresh multimetal catalyst and the deactivated and metals contaminated hydrodesulfurization catalyst will contain the same metals, i.e. Group VB, Group VIB and Group VIII metals. A fresh multimetal catalyst containing Group VB, Group VIB and Group VIII metals will behave in a manner similar to a metals contaminated and deactivated hydrodesulfurization catalyst in the process which is the subject of this invention.

The fresh multimetal catalyst comprises a Group VB, a Group VIB and a Group VIII metal or mixtures thereof on an inorganic metal support. Examples of the metals include: Group VB—vanadium, niobium and tantalum; Group VIB—chromium, molybdenum and tungsten; Group VIII—cobalt and nickel. These metals should be in their oxide or sulfide form but regardless of their initial condition they will be converted to the sulfide form in use. Various combinations of these three groups may be employed including vanadium-cobalt-molybdenum, vanadium-nickel-tungsten and the like. The Group VIII noble metals, such as platinum and palladium may be employed but are generally not favored because they are more readily poisoned then the other Group VIII metals. The catalytic metals are normally employed in a finely divided form and are deposited on a porus support, with little or no cracking activity. Alumina is the most commonly employed support material. As used herein the term "fresh" catalyst includes a new catalyst never utilized before as well as a regenerated and reusable catalyst.

The hydrodesulfurization catalysts employed in the process of this invention are those conventionally employed in hydrodesulfurization processes being practiced commercially. In general these catalysts are selected from Group VIB and Group VIII metals on an inorganic metal oxide support. Examples of such metals include chromium, molybdenum, tungsten, cobalt, and nickel. These metals should be in their oxide or sulfide form but regardless of of their initial conditions they will be converted to the sulfide form in use. These metals are employed alone or in various combinations. Among the most commonly used combinations are the nickel-tungsten, the cobalt-molybdenum and the nickel-cobalt-molybdenum combinations. Although the Group VIII nobel metals, such as platinum and palladium, may be employed, they are more readily poisoned by the compounds found in the feedstocks being treated here than are the other metals and are generally not favored. The catalyst metals are normally used in a finely divided form and are deposited on a porous support, which has little or no cracking activity. An alumina support is the one most commonly employed. Hydrodesulfurization catalysts such as cobalt-molybdenum on alumina or nickel-tungsten on alumina are particularly preferred in practicing the present invention. However, these catalysts need not be in a fresh or newly activated conditions to be usefully employed herein. In fact, a hydrodesulfurization catalyst having a high activity level is not necessary when practicing the present invention. A hydrodesulfurization catalyst which has been used in hydrodesulfurization and has become inactive because of carbonaceous deposits and metallic contaminants deposited thereon still retains some activity and is ideally suited and preferred for use in the present invention. Thus, an especially preferred useful catalyst in one embodiment of this process is one comprising a Group VIB metal and a Group VIII metal on an inorganic metal oxide support have substantially no cracking activity and which has been temporarily deactivated, but susceptible to oxidative regeneration, in a hydrodesulfurization process and which contains metal contamination comprising nickel and vanadium.

It is necessary to conduct all embodiments of the subject process in the presence of hydrogen and hydrogen sulfide. It is not necessary, however, that either the hydrogen or the hydrogen sulfide be 100% pure. Refinery waste gases containing significant concentrations of hydrogen sulfide and hydrogen may therefore be used. The gas phase in the reaction zone must contain at least 10 mole percent hydrogen and 10 mole percent hydrogen sulfide, although, higher concentrations are desirable. Preferably, the hydrogen sulfide concentration should be between 10 and 90 mole percent and the hydrogen concentration should also be between 10 and 90 mole percent.

In the oxygen and nitrogen transformation effected by the process of this invention, the optimum reaction temperature will vary depending upon the specific catalyst employed, the degree of its deactivation and the concentration of the impurities, particularly the metals, found thereon. The reaction temperature should be selected so that a substantial portion of the nitrogen-containing and oxygen-containing components of the distillate being treated are converted to the corresponding sulfur compounds. Generally, temperatures in the range of about 700 to about 875° F., preferably about 775° to 825° F. are found to be useful. Other operating conditions include a pressure in the range of about 200 to about 2000 psig, preferably about 400 to about 1000 psig. The hydrogen sulfide and hydrogen feed rates should each be about 300 to about 5000 standard cubic feet per barrel, preferably about 500 to 3000 standard cubic feet per barrel. When employing the fresh multimetal catalyst in this process a space velocity (WHSV) of about 0.1 to about 50, preferably about 5 to about 30, is employed. With the deactivated, metals contaminated hydrodesulfurization catalyst, the space velocity must be substantially decreased to about 0.1 to 10.0, preferably about 1 to about 5. The operating conditions may be adjusted by those skilled in the art to obtain the optimum transformation of the oxygen and sulfur compounds in a particular feed to the corresponding sulfur compounds.

Ideally, the process of this invention may be integrated with an existing multi-reactor hydrodesulfurization unit. During normal hydrodesulfurization operation, one reactor containing a fixed bed of hydrodesulfurization catalyst is employed until the catalyst activity level indicates that regeneration is required. This reactor is then taken out of service for regeneration and one of the reactors containing a freshly regenerated bed of catalyst is brought on-stream. Conveniently, then, before the deactivated but regenerable bed of hydrodesulfurization catalyst is regenerated it can be utilized as the catalyst in the present invention.

In a similar fashion, a reactor containing a bed of the fresh multimetal catalyst may be utilized upstream of an existing hydrodesulfurization unit to provide the desulfurization unit with a feedstream where substantial quantities of the nitrogen and oxygen contaminants have been converted to the corresponding sulfur compounds. This will permit the desulfurization unit to operate under less severe conditions.

Although a deactivated and metals contaminated hydrodesulfurization catalysts may be the catalyst most commonly employed in practicing this invention, a fresh multimetal catalyst containing the same catalytically active metals found in the deactivated hydrodesulfurization catalyst, including those metal contaminants which are catalytically active, is employed in one embodiment of this invention. The use of a fresh catalyst might suggest that this embodiment would not be as economically attractive as those embodiments utilizing the deactivated catalyst. However, adjustments to the operating conditions, particularly the space velocity, may make this embodiment attractive in some special situations. Briefly, the fresh multimetal catalyst of this embodiment is the hydrodesulfurization catalyst described hereinbefore but in fresh condition and containing a Group VB metal as an additional metal catalyst.

Although not wishing to be bound by this theory, it would appear that the vanadium and nickel metal contamination on the hydrodesulfurization catalyst, particularly the vanadium contaminant, serves as the catalyst in the subject invention whereby the nitrogen and oxygen components of a distillate are transformed to the corresponding sulfur compounds.

The following examples will serve to illustrate the subject invention.

A series of runs was conducted with Paraho shale oil by subjecting it to elevated temperatures and pressures in the presence of hydrogen and hydrogen plus hydrogen sulfide. Both catalytic and thermal, i.e., non-catalytic, runs were performed. The reactor was a ¼ in. I.D. coiled stainless steel tube reactor 144 in. long. In the thermal runs, the reactor was packed with 50 cc of 20/30 mesh Vycor glass and heated by a fluidized bath to 750° F. In the catalytic runs, 16.7 grams of spent Co/Mo hydrodesulfurization catalyst (rod-shaped sized to 14/20 mesh) was mixed with enough 20/30 mesh Vycor glass to provide a 50 cc volume bed. The shale oil feed was introduced into the reactor after having passed through a preheated section maintained at 500° F.

A stream of hydrogen at 3000 SCF/bbl and a pressure of 700 psig was introduced into the reactor. When hydrogen sulfide was required, it was added to the hydrogen stream by utilizing a liquid $H_2S$ bubbler system maintained at 11° C. so as to provide about 40 mole percent $H_2S$ in the gas stream. The spent cobalt-molybdenum hydrodesulfurization catalyst had been used previously to process a light Arabian atmospheric resid. The properties of this spent catalyst and a comparison of its activity and that of a fresh Co/Mo catalyst using a model feed are set forth in Table 1 below.

TABLE I

| Spent Co/Mo HDS Catalyst | |
|---|---|
| Surface area | 34 |
| Real density | 2.55 |
| Particle density | 2.18 |
| Pore volume (cc/g) | 0.067 |
| % S | 6.76 |
| Ni | 0.92 |
| V | 5.3 |
| C | 12.0 |
| Ash-misc. | 67.4 |

Activity Comparison*

| Activity | Fresh Co/Mo Catalyst WHSV = 43 | Spent Co/Mo Catalyst WHSV = 6.4 |
|---|---|---|
| Hydrodesulfurization | 69% | 20% |
| Hydrodenitrogenation | 3.4 | 1% |
| Aromatics Hydrogenation | 12% | 0 |
| *Model feed used for comparisons: | | |
| dibutyl sulfide | 14.9 wt. % | 3.2 wt. % S |
| 1-methylnaphthalene | 14.2 | |
| dibenzothiophene | 18.4 | 3.2 wt. % S |
| quinoline | 6.5 | 0.7 wt. % N |
| 1,2,4-trimethylbenzene | 46.3 | |
| VO (tetraphenylporphyrin) | | 4.4 ppm V |

A total of four runs were made which included two thermal runs, one in the presence of hydrogen and the other in the presence of hydrogen sulfide and hydrogen and two catalytic runs, one in the presence of hydrogen and the other in the presence of hydrogen and hydrogen sulfide.

Data on the feed, the operating conditions and the results of these runs are presented in Table 2 below while the boiling range distribution of the feed and products is presented in Table 3 below. As used herein, all percentages are by weight unless otherwise specified.

TABLE 2

| Pressure, 700 psig $H_2S$ = 40 mol % | Shale Oil Charge | Thermal $H_2$ | Thermal $H_2S + H_2$ | Spent Co—Mo Cat. $H_2$ | Spent Co—Mo Cat. $H_2 + H_2S$ |
|---|---|---|---|---|---|
| Processed at: | | | WHSV: | 2.4 | 2.4 |
| LHSV | | 0.6 | 0.6 | 0.5 | 0.5 |
| Temp. (°F.) | | 750 | 750 | 750 | 750 |
| Pour Point | 80 | 72 | 59 | 39 | 52 |
| CCR | 2.78 | —* | 2.51 | 1.20 | 1.65 |
| Analysis: | | | | | |
| Basic N | 1.33 | 1.33 | 1.28 | 1.26 | 1.22 |
| Total N | 2.12 | 2.09 | 1.87 | 1.63 | 1.50 |
| O | 1.53 | 1.07 | 1.01 | 0.54 | 0.35 |
| S | 0.81 | 0.39 | 1.32 | 0.32 | 0.41 |
| C | 84.25 | 85.13 | 84.93 | 85.71 | 85.39 |
| H | 11.03 | 11.26 | 11.24 | 11.97 | 11.64 |
| | 99.74 | 99.94 | 100.37 | 100.17 | 99.29 |
| Mole ratio H/C | 1.57 | 1.59 | 1.59 | 1.68 | 1.64 |
| deN(1) | | 1.4 | 11.8 | 23.1 | 29.2 |
| deO | | 30.0 | 34.0 | 64.7 | 77.1 |
| deS | | 51.9 | 0 | 60.5 | 49.4 |
| deCCR | | | | 56 | 40 |
| Trace elements: | | | | | |
| As ppm | 26 | 5 | 1.5 | <0.3 | <0.3 |
| Fe ppm | 26 | 11 | 5 | 12 | 7 |
| Hydrogen: | | | | | |
| Consumption (SCF/BBL) | | 159 | 145 | 819 | 483 |
| Wt. % gas make ($C_1$-$C_5$ gases) | | 0.4 | 0.9 | 2.7 | 1.3 |

*Insufficient sample for analysis.
(1)deN = percent removal of nitrogen
deO = percent removal of oxygen
deS = percent removal of sulfur
deCCR = percent removal of Conradson carbon

TABLE 3

| | Gases | IBP-420 | 420-650 | 650-850 | 850-1075 | 1075+ | 1075° F.⁻ Conv.* |
|---|---|---|---|---|---|---|---|
| | | Boiling Range Distribution | | | | | |
| Feed | | 7.5 | 28.2 | 34.3 | 15.8 | 14.2 | |
| Thermal | | | | | | | |
| $H_2$ | 0.14 | 10.5 | 19.2 | 31.8 | 18.3 | 20.3 | 0 |
| $H_2S + H_2$ | 0.89 | 7.6 | 18.6 | 24.8 | 28.9 | 19.1 | 0 |
| Co—Mo spent catalyst | | | | | | | |
| $H_2$ | 2.7 | 12.2 | 23.5 | 29.8 | 22.7 | 8.9 | 37 |
| $H_2S + H_2$ | 1.3 | 14.6 | 24.7 | 36.0 | 14.9 | 8.6 | 39 |

*Conversion to 1075° F.⁻ = $\frac{(1075°\text{ F.}^- \text{ liquid} + \text{gas}) - 85.8}{14.2} \times 100$ The thermal treatment of shale oil with either hydrogen or hydrogen sulfide plus hydrogen removed some heteroatoms of nitrogen and oxygen and improved the mole ratio of hydrogen to carbon slightly. While total nitrogen was reduced, the basic nitrogen component was fairly unreacted under these thermal conditions. The combination of hydrogen sulfide and hydrogen gave improved nitrogen removal as compared to hydrogen only. The trade-off for removal of more nitrogen apparently was the failure to effect desulfurization. Table 3 shows that while shifts in boiling ranges occurred, the thermal treatment gave no net conversion to 850° F. or 1075° F. of boiling materials. More heavy ends were produced, probably due to thermal polymerization type rections. When the shale oil was treated in the presence of the spent hydrodesulfurization catalyst, the level of heteroatom removal of nitrogen and oxygen was considerably improved as compared to the non-catalytic thermal treatments. In addition, Table 2 shows that the hydrogen to carbon mole ratio was significantly improved as compared to the thermal runs. The atmosphere of hydrogen sulfide and hydrogen together with the catalyst gave substantial levels of nitrogen and oxygen removal which where also higher than those achieved with hydrogen alone. Again basic nitrogen was little affected whether $H_2S+H_2$ or $H_2$ alone was used. The hydrogen sulfide plus hydrogen atmosphere apparently inhibited desulfurization slightly in the runs conducted in the presence of deactivated hydrodesulfurization catalyst. Table 3 shows that with the spent Co/Mo catalyst there was a conversion to lower boiling materials. Regardless of the atmosphere employed the conversion to 1075° F. exceeded 35% in both catalyst runs.

These four runs demonstrate that significant transformation of the nitrogen and oxygen components of a hydrocarbon oil to the corresponding sulfur compounds is achieved when the oil is contacted with an atmosphere of hydrogen and hydrogen sulfide in the presence of a deactivated but regenerable hydrodesulfurization catalyst.

What is claimed is:

1. A process for the transformation of nitrogen-containing or oxygen-containing components of a mineral oil to sulfur-containing components which comprises:

contacting a mineral oil comprising nitrogen-containing or oxygen-containing components with a gaseous mixture containing hydrogen and hydrogen sulfide which comprises between 10 and 90 mole percent hydrogen sulfide, and a fresh multimetal catalyst under process conditions effective to transform nitrogen-containing or oxygen-containing components to sulfur-containing components of said mineral oil, including a temperature of about 700° to about 875° F., said multimetal being a Group VB metal, a Group VIB metal, and a Group VIII metal or mixtures thereof.

2. A process according to claim 1 wherein the catalyst comprises Group VB, Group VIB and Group VIII metals on an inorganic metal oxide support, said support having substantially no cracking activity.

3. A process according to claim 1 wherein the Group VB metal is vanadium, the Group VIB metal is molybdenum or tungsten, the Group VIII metal is cobalt or nickel and the metals are in oxide or sulfide form.

4. A process according to claim 1 wherein the mineral oil is virgin naphtha, cracked naphtha, virgin gas oil, cycle gas oil, middle distillate or lubricating oil distillate.

5. A process according to claim 1 wherein the mineral oil is a coal derived liquid, a shale oil derived liquid, a tar sands derived liquid or an organic matter derived liquid.

6. A process according to claim 1 wherein the process conditions include a pressure of about 200 to about 2000 psig and a WHSV of about 0.1 to about 50.0.

7. A process for substantially reducing the nitrogen, oxygen and sulfur content of a mineral oil containing significant quantities of nitrogen, oxygen and sulfur components which comprises:

(a) contacting a mineral oil comprising nitrogen-containing components, oxygen-containing components, and sulfur-containing components with a gaseous mixture containing hydrogen and hydrogen sulfide which comprises between 10 and 90 mole percent hydrogen sulfide, and a fresh multimetal catalyst under process conditions effective to transform nitrogen-containing and oxygen-containing components of said mineral oil to sulfur-containing components, including a teperature of about 700° to about 875° F., said multimetal being a Group VB metal, a Group VIB metal and a Group VIII metal or mixtures thereof, and (b) passing the treated mineral oil of step (a) in contact with a hydrodesulfurization catalyst under hydrodesulfurization conditions effective to substantially reduce the sulfur content of the treated mineral oil.

8. A process according to claim 7 wherein the hydrodesulfurization catalyst of step (b) comprises Group VIB and Group VIII metals on an inorganic metal oxide support, said support having substantially no cracking activity.

9. A process for the transformation of nitrogen-containing or oxygen-containing components of a mineral oil to sulfur-containing components which comprises:

contacting a mineral oil comprising nitrogen-containing or oxygen-containing components with a gaseous mixture containing hydrogen and hydrogen sulfide which comprises between 10 and 90 mole percent hydrogen sulfide, and a deactivated and metals contaminated hydrodesulfurization catalyst under process conditions effective to transform nitrogen-containing or oxygen-containing components to sulfur-containing components of said mineral oil, including a temperature of about 700° to about 875° F., said hydrodesulfurization catalyst contaminated with metals comprising nickel and vanadium and said hydrodesulfurization catalyst comprising Group VIB and Group VIII metals and mixtures thereof.

10. A process according to claim 9 wherein the catalyst comprises Group VIB and Group VIII metals on an inorganic metal oxide support, said support having substantially no cracking activity.

11. A process according to claim 9 wherein the Group VIB metal is molybdenum or tungsten, the Group VIII metal is cobalt or nickel and the metals are in oxide or sulfide form.

12. A process according to claim 9 wherein the mineral oil is virgin naphtha, cracked naphtha, virgin gas oil, cycle gas oil, middle distillate or lubricating oil distillate.

13. A process according to claim 9 wherein the mineral oil is a coal derived liquid, a shale oil derived liquid, a tar sands derived liquid or an organic matter derived liquid.

14. A process according to claim 9 wherein the process conditions include a pressure of about 200 to about 2000 psig and a WHSV of about 0.1 to about 10.0.

15. A process according to claim 9 wherein the catalyst is temporarily deactivated and susceptible to oxidative regeneration.

16. A process for substantially reducing the nitrogen, oxygen and sulfur content of a mineral oil containing significant quantities of nitrogen, oxygen and sulfur components which comprises:

(a) contacting a mineral oil comprising nitrogen-containing components, oxygen-containing components, sulfur-containing components, nickel and vanadium with a gaseous mixture containing hydrogen and hydrogen sulfide which comprises between 10 and 90 mole percent hydrogen sulfide, and a deactivated and metals contaminated hydrodesulfurization catalyst under process conditions effective to transform nitrogen-containing and oxygen-containing components of said mineral oil to sulfur-containing components, including a temperature of about 700° to about 875° F., said contaminated hydrodesulfurization catalyst contaminated with metals comprising nickel and vanadium, and (b) passing the treated mineral oil to step (a) in contact with a hydrodesulfurization catalyst under hydrodesulfurization conditions effective to substantially reduce the sulfur content of the treated mineral oil, said hydrodesulfurization catalysts of steps (a) and (b) comprising Groups VIB and Group VIII metals and mixtures thereof.

17. A process according to claim 16 wherein the catalyst of step (a) was deactivated and contaminated previously in step (b).

18. A process according to claim 16 wherein the hydrodesulfurization catalysts of steps (a) and (b) comprise Group VIB and Group VIII metals on an inorganic metal oxide support, said support having substantially no cracking activity.

* * * * *

UNITED STATES PATENT AND TRADEMARK OFFICE

CERTIFICATE OF CORRECTION

PATENT NO. : 4,414,102

DATED : November 8, 1983

INVENTOR(S) : Lillian A. Rankel and Leslie R. Rudnick

It is certified that error appears in the above—identified patent and that said Letters Patent is hereby corrected as shown below:

Column 11, Line 3, "teperature" should be --temperature--

Signed and Sealed this

*Fifteenth* Day of *May 1984*

[SEAL]

*Attest:*

GERALD J. MOSSINGHOFF

*Attesting Officer*

*Commissioner of Patents and Trademarks*